US006401987B1

(12) United States Patent
Oechsel et al.

(10) Patent No.: US 6,401,987 B1
(45) Date of Patent: Jun. 11, 2002

(54) FLUID PRODUCT DISPENSER

(75) Inventors: François Oechsel, Louviers; Bruno Simon, La Haye Malherbe, both of (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/959,978

(22) Filed: Nov. 14, 2001

(30) Foreign Application Priority Data

May 21, 1999 (FR) ..... 99 06495

(51) Int. Cl.[7] ..... B65D 88/54
(52) U.S. Cl. ..... 222/321.7
(58) Field of Search ..... 222/36, 153.13, 222/153.14, 162, 320, 321.1, 321.7, 386

(56) References Cited

U.S. PATENT DOCUMENTS 4,871,092 A * 10/1989 Maerle ..... 222/153.13
5,228,586 A * 7/1993 Fuchs ..... 222/321.7
5,335,823 A * 8/1994 Fuchs et al. ..... 222/153.13
5,427,280 A * 6/1995 Fuchs ..... 222/320
5,511,698 A * 4/1996 Solignac ..... 222/321.1
6,257,457 B1 * 7/2001 Oechsel ..... 222/320

* cited by examiner

*Primary Examiner*—William Doerrler
*Assistant Examiner*—Thach H. Bui
(74) *Attorney, Agent, or Firm*—Sughrue Mion, PLLC

(57) ABSTRACT

A fluid dispenser device comprising a body (10) defining a dispensing orifice (11), and a reservoir (20) containing one or more doses of fluid, said reservoir (20) having a piston (25) which, at rest, forms a leaktight stopper, said device being characterized in that it further comprises a resilient element (30), such as a spring, that co-operates firstly with said reservoir (20) or with said piston (25), and secondly with a cocking member (40), said cocking member (40) being mounted to be movable manually relative to said body (10) so as to compress said spring (30), and being mounted to be lockable relative to said body (10) in at least one locked position in which said spring (30) is compressed, said device including at least one triggering member (50, 51) adapted to release said spring (30) so as to move said at least one piston (25) relative to said reservoir (20) so as to expel a dose of fluid.

15 Claims, 5 Drawing Sheets

FLUID PRODUCT DISPENSER

The present invention relates to a fluid dispenser device, and more particularly to a fluid dispenser device serving to dispense a limited number of doses, such as a single dose or two doses.

Devices of the single-dose or two-dose type are well known in the state of the art, and can be used in the field of pharmaceutical dispensers for nasal use, in which one dose of fluid is to be dispensed in each nostril.

Document FR-2 761 281 discloses such a two-dose device. To use that device, the user places the dispensing orifice in the nostril and exerts axial pressure on the actuating element of the device. That axial pressure must be high enough to overcome energy storage means in order to guarantee that each dose is dispensed in full. When that relatively large axial force is applied, it is difficult for the position of that end of the device which is provided with the dispensing opening to be controlled accurately in the nostril, and it is possible that the end of the head of the device might collide with the inside of the nostril, which can be problematic and/or painful for the user. In addition, because that device requires at least a minimum predetermined force in order to be actuated, it can be difficult for old people or people with reduced mobility to use it, since they might have difficulties exerting said force with the device in place in the nostril.

An object of the present invention is to provide a fluid dispenser device, in particular a device of the two-dose type, that does not suffer from the above-mentioned drawbacks.

In particular, an object of the present invention is to provide a fluid dispenser device such as a two-dose device that is simple and reliable to use, and in which the fluid is dispensed independently of the actuating force exerted by the user.

Another object of the present invention is to provide such a dispenser device that guarantees that a dose is dispensed in full each time the device is actuated, while also guaranteeing that the fluid is contained in leaktight manner before and after dispensing takes place.

Another object of the present invention is to provide such a device that facilitates assembly and filling, and that, in particular, makes it possible to use a pre-filled reservoir, so that the device does not necessarily have to be finally assembled in a sterile environment.

The present invention thus provides a fluid dispenser device comprising a body defining a dispensing orifice, and a reservoir containing one or more doses of fluid, said reservoir having a piston which, at rest, forms a leaktight stopper, said device being characterized in that it further comprises a resilient element, such as a spring, that co-operates firstly with said reservoir or with said piston, and secondly with a cocking member, said cocking member being mounted to be movable manually relative to said body so as to compress said spring, and being mounted to be lockable relative to said body in at least one locked position in which said spring is compressed, said device including at least one triggering member adapted to release said spring so as to move said at least one piston relative to said reservoir so as to expel a dose of fluid.

In a first embodiment of the invention, said piston co-operates in stationary manner with said body and said spring co-operates with an intermediate element secured to said reservoir and mounted to move with said reservoir relative to said body, said intermediate element being locked relative to said body in at least one locked position, and being released by said at least one triggering member, so that, by moving with the reservoir relative to said body under the effect of the spring, the intermediate element moves said piston in said reservoir so as to dispense a dose of fluid.

Advantageously, said reservoir includes a hollow tube that is open at one end only, which end is closed off by a stopper piston provided with a slit adapted to open under the effect of a determined pressure generated inside the reservoir by the movement of the piston, so as to dispense the fluid from the reservoir towards the dispensing orifice.

Advantageously, after being filled and closed off in leaktight manner by said piston said reservoir is fixed, in particular by snap-fastening, to said intermediate element.

In a second embodiment of the present invention, said reservoir is fixed to said body, and said piston co-operates with an intermediate element urged by said spring and that moves with said piston relative to said body, said intermediate element being locked relative to said body in at least one locked position, and being released by said at least one triggering member, so that, by moving with the piston relative to said body under the effect of the spring, the intermediate element moves said piston in said reservoir so as to dispense a dose of fluid.

Advantageously, said reservoir includes a hollow tube that is open at both ends, and that is closed off at one end by said piston co-operating with the intermediate element and at the other end by a stopper co-operating in stationary manner with the body, said stationary stopper being provided with a slit adapted to open under the effect of a determined pressure generated inside the reservoir by the piston moving, so as to dispense the fluid from the reservoir to the dispensing orifice.

Preferably, said intermediate element has at least one locking element, such as a resilient catch, co-operating with at least one opening in the body to lock said intermediate element relative to said body, said intermediate element being released by said at least one triggering member co-operating with said at least one locking catch through said at least one opening.

Advantageously, said at least one triggering member is made in the form of a side push button mounted to move radially and adapted to co-operate with said intermediate element.

Advantageously, said at least one triggering member is formed on an external element fixed to said body and it is provided with an inwardly-projecting lug adapted to co-operate with said intermediate element through at least one corresponding opening provided in said body when the triggering member is actuated.

Preferably, said reservoir contains two doses of fluid, said cocking member has two distinct locked positions, one for each dose, said intermediate element has two distinct locked positions, one for each dose, and said device has two distinct triggering members one for each dose.

Advantageously, the two triggering members are offset axially and/or peripherally relative to each other on the body of the device.

In another variant embodiment of the present invention, the reservoir is a syringe which, at one end, includes a piston that co-operates with said intermediate element, and, at the other end, includes an end-piece which, at rest, forms closure means, and, when the device is actuated, defines a spray profile at the dispensing orifice.

Advantageously, said body incorporates said at least one triggering member, and an inner sleeve is fixed in said body, said sleeve co-operating with said intermediate element, and with said cocking member to define their respective locked positions, and co-operating with said at least one triggering member to release said intermediate element.

Preferably, said cocking member is released from its locked position(s) when the user exerts a predetermined axial force on it.

Advantageously, said reservoir is made of glass, and said piston is made of an elastomer material.

Other advantages and characteristics of the present invention appear from the following description of embodiments of the present invention, given by way of non-limiting example, and with reference to the accompanying drawings, in which.

Figure 1:
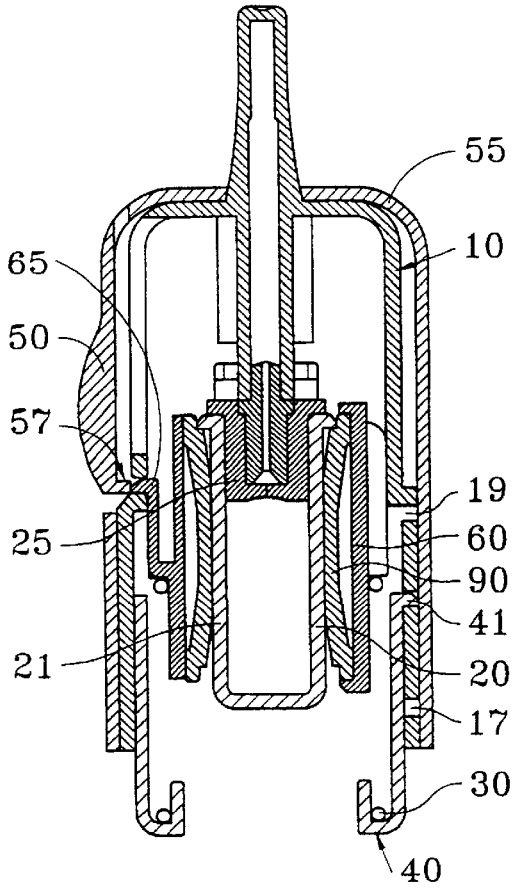
FIG. 1 is a diagrammatic view in cross-section of a fluid dispenser device of the two-dose type in a first embodiment of the present invention, before the first dose is dispensed.

The present invention is described with reference to three variant embodiments shown in the drawings, and which concern fluid dispenser devices of the two-dose type, i.e. containing two doses of fluid to be dispensed, the fluid being to be dispensed into the nose of the user. It is to be understood that the present invention may also apply to single-dose devices, i.e. containing a single dose to be dispensed. Similarly, the present invention may be applied to multi-dose dispensers containing more than two doses, e.g. three of four doses. In addition, the present invention is not limited to nasal-type dispensers.

Figure 2:
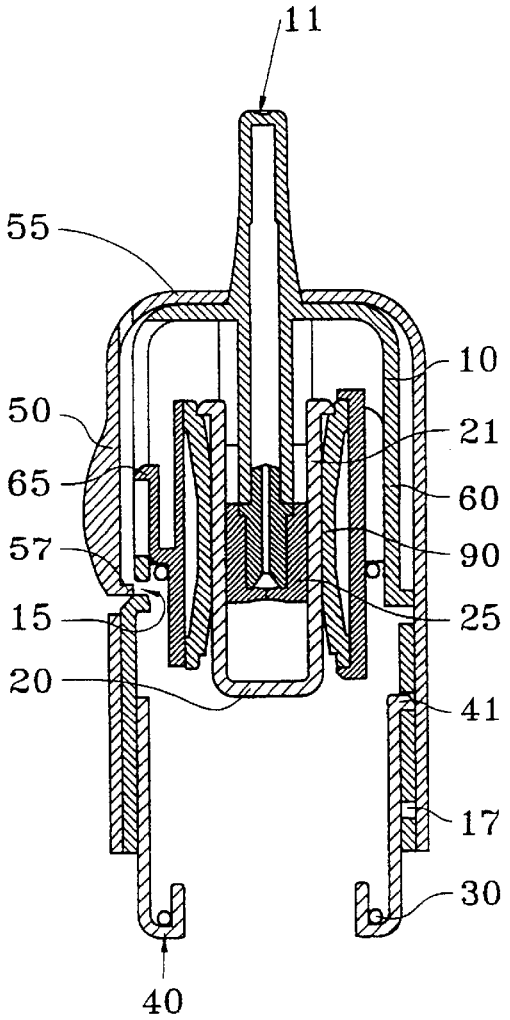
FIG. 2 is a view similar to the view of FIG. 1, after the first dose is dispensed.
Figure 3:
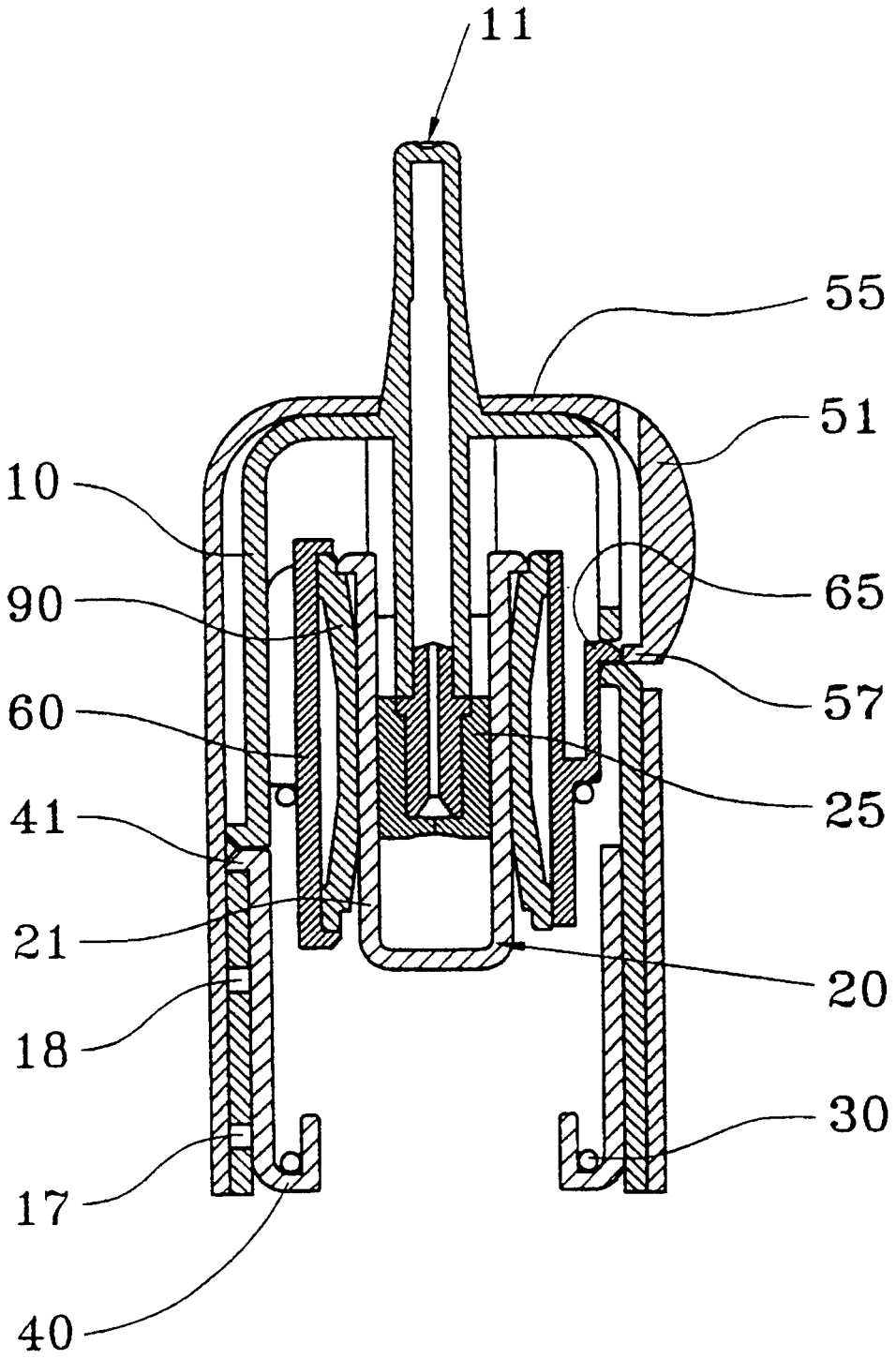
FIG. 3 is a view similar to the views of FIGS. 1 and 2, before the second dose is dispensed.

FIGS. 1 to 3 show a first embodiment of the present invention. In this first embodiment, the device includes a reservoir 20 that is preferably formed by a glass tube 21 that is open at one end only, and whose opening is closed off by a stopper piston 25. Thus, the reservoir 20 can be filled separately with the fluid to be dispensed, and can then be fitted in the dispenser device of the invention. The dispenser device is thus not necessarily assembled under sterile conditions, which offers a major advantage, in particular when the manufacturer of the fluid to be dispensed is not the manufacturer of the dispenser device.

The device includes a body 10 incorporating a dispensing opening 11. In the examples shown in the drawings, which concern dispensers of the nasal type, the dispensing orifice 11 is situated at the end of a nasal applicator end-piece which incorporates the dispensing channel, in which a spray insert can advantageously be disposed so as to facilitate good spraying and so as to limit the dead volume. Inside the body 10, an intermediate element 60 is also provided that is mounted to move axially relative to said body 10, and that has at least one locked position in which it is locked relative to said body 10. Since the example shown is a two-dose device, the intermediate element 60 has two locked positions, one for each dose. FIG. 1 shows the intermediate element 60 in its first locked position. Advantageously, the intermediate element 60 is provided with at least one locking element 65, such as a flexible resilient catch, which advantageously co-operates with at least one corresponding opening 15, 16 provided in the body 10. In the example shown in FIGS. 1 to 3, the body 10 is provided with a first opening 15, in which said flexible resilient catch 65 snap-fastens in its first locked position, before the first dose is dispensed (FIG. 1), and with a second opening 16 in which said resilient catch 65 of the intermediate element 60 snap-fastens before the second dose is dispensed (FIG. 3). The intermediate element 60 is urged by a spring 30 which co-operates at one end with said intermediate element 60 and at the other end with a cocking member 40 that is also disposed to slide axially in said body 10. Said cocking member 40 has at least one locked position. Since this example is a two-dose device, and like the intermediate element 60, the cocking member 40 has two locked positions, one for each dose. FIGS. 1 and 2 show the cocking member in its first locked position, and FIG. 3 shows said cocking member 40 in its second locked position. Advantageously, the cocking member 40 has at least one locking element 41, such as a flexible catch or an outwardly-projecting lug which co-operates with at least one corresponding opening 17, 18, 19 provided in the body 10 of the device. The cocking member 40 and the intermediate element 60 are made such that they can slide axially relative to the body in one direction only, namely, in the figures, in the upward direction from the bottom to the top of the device. For this purpose, the lugs or the resilient catches 65, 41 may have sloping top surfaces so that they can be deformed and disengaged from the openings in the body so as to be moved axially upwards, and plane horizontal bottom surfaces that prevent any return movement of the two elements in the opposite direction. Naturally, the figures show merely particular embodiments, and other equivalent means could be used to enable the cocking member 40 and the intermediate element 60 to move in one direction only, and to define the locked positions of these two parts.

In the invention, the device includes at least one triggering member for dispensing the fluid. In the example shown, which is two-dose, the device has two triggering members, one for each dose. These triggering members 50 and 51 are preferably formed on an outer element 55 fixed to the outside of the body 10, and they are advantageously made in the form of push buttons, each of which includes a triggering element 57, such as an inwardly-projecting lug, which co-operates through the openings 15; 16 in the body 10 with the intermediate element 60, and in particular with the resilient catch 65 thereof. When the device is two-dose, the two triggering members 50 and 51 are advantageously offset axially relative to each other on the body 10, so that there is no risk of confusion for the user, the bottom push-button 50 serving to dispense the first dose, and the top push button 51 serving to dispense the second dose. In the examples shown, the two triggering members are also offset peripherally, advantageously by an angle of 90°.

As explained above, in the first embodiment, the pre-filled reservoir 20 can be fixed, in particular by snap-fastening, in the intermediate element 60, advantageously by means of a snap-fastening member 90 fixed to the intermediate element 60 and having a certain amount of resilience, and enabling the pre-filled reservoir to be positioned correctly and fixed in the already-assembled dispenser device.

The first embodiment of the device of the invention operates as follows.

When the user wishes to dispense a first dose of fluid, the user exerts axial pressure on the cocking member so as to push it into the body 10. In the starting position (not shown), the cocking member is in a rest position in which its projecting lug 41 cooperates with an opening 17 in the body 10. The cocking member 40 is made such that, as from a predetermined axial force exerted on it, it can be disengaged from its locked position, and in particular the lug 41 can be disengaged from said first opening 17, thereby enabling the cocking member 40 to slide in said body 10 until said lug 41 comes to co-operate with a second opening 18 in the body 10, which opening is offset axially upwards relative to the first opening 17. This sliding of the cocking member cocks the spring 30 which is disposed between said cocking member and the intermediate element 60, which is stationary during this first cocking stage, because it is in its first locked position, in which its lug or resilient catch 65 co-operates with the corresponding opening 15. When the cocking member, and in particular its lug 41, comes to co-operate with the second opening 18 in the body 10, the cocking member is in its first locked position, in which the spring 30 is compressed and the cocking member 40 is prevented from returning back to its initial rest position. This first locked position is shown in FIG. 1.

Once the device is cocked, and when the user wishes to dispense the first dose of fluid, said user places the dispensing orifice 11 in the nostril and presses, by exerting radial pressure, on the first triggering member 50. This radial pressure on the first triggering member 50 moves the lug 57 radially inwards, thereby pushing the resilient catch. 65 of the intermediate element 60 out of the opening 15. The intermediate member 60 is thus released from its first locked position, and the compressed spring 30 then moves the intermediate element inside the body 10 to its position shown in FIG. 2. Since the reservoir 20 is secured to the intermediate element 60, and the piston 25 is secured to the body 10, this movement of the intermediate element 60 causes the piston 25 to be moved inside the reservoir 20, thereby enabling the first dose of fluid to be dispensed. The volume of the dispensed dose is thus defined by the axial stroke of the intermediate element. This axial stroke is determined by an abutment position corresponding to the second locked position of the intermediate element 60, in which the resilient catch 65 comes to co-operate with its corresponding second opening 16 in the body 10. If the triggering members 50 and 51 are offset around the periphery of the body 10, the intermediate element has at least two resilient catches 65, which are also offset around the periphery of the intermediate element 60 so as to co-operate with the openings 15; 16 which are also offset peripherally on the body 10. In an advantageous variant, each triggering member 50 and 51 is made up of a respective pair of diametrically-opposite push buttons, requiring each pair to be squeezed simultaneously between two fingers in order to actuate the device. In which case, the intermediate element 60 is provided with respective pairs of diametrically-opposite resilient catches 65 in corresponding manner.

Once the first dose of fluid has been dispensed, the device is thus in a position in which the cocking member 40 is in its first locked position, and the intermediate element 60 is in its second locked position. In order to prepare the second dose, the user actuates the cocking member 40 once again by exerting axial pressure on it again, as above. Similarly, as from a predetermined axial pressure, the cocking member slides inside the body 10 until its lug 41 comes to co-operate with a third opening 19 provided in the body 10 so as to define the second locked position of the cocking member 40. Once again, the spring 30 is compressed during this cocking operation, because the intermediate element 60 is locked in its second locked position. The device is then brought to the position shown in FIG. 3, ready to be used to dispense the second dose. The user places the device in the other nostril, and actuates the second triggering member 51 which, via its lug 57, releases the intermediate element 60 from its second locked position, thereby enabling the reservoir 20 to move again relative to the piston 25, so as to dispense the remainder of the fluid, namely the second dose.

Advantageously, the piston 25, which, in the rest position, forms a leaktight stopper, is made such that it has a slit adapted to open as from a predetermined pressure generated inside the reservoir, so as to enable the fluid to be dispensed.

Figure 4:
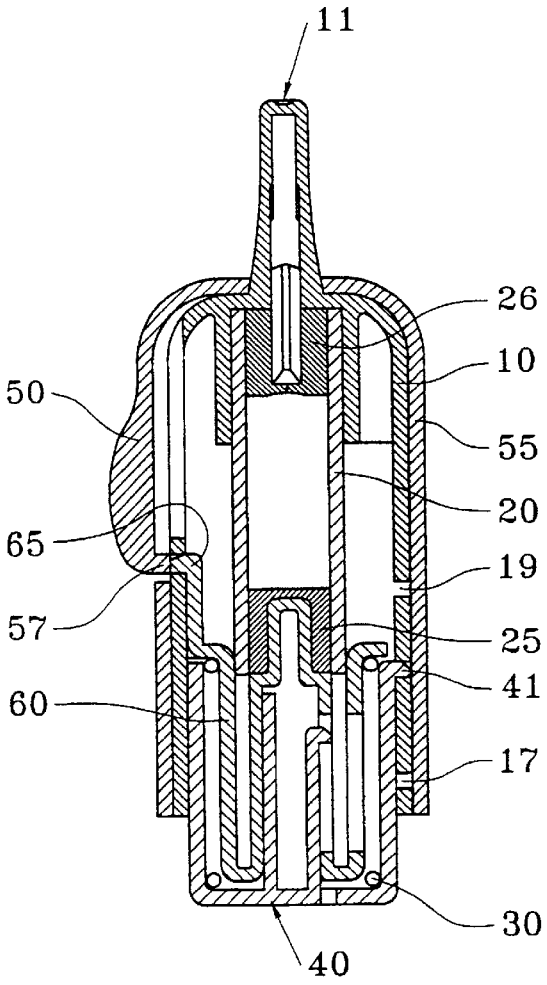
FIG. 4 is a diagrammatic view in cross-section of a fluid dispenser device of the two-dose type in a second embodiment of the present invention, before the first dose is dispensed.
Figure 5:
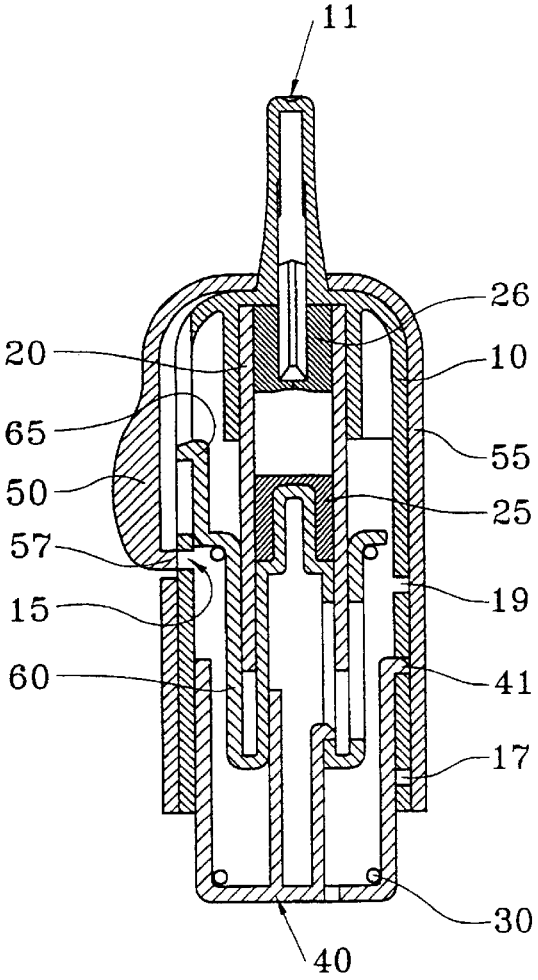
FIG. 5 is a view similar to the view of FIG. 4, after the first dose is dispensed.
Figure 6:
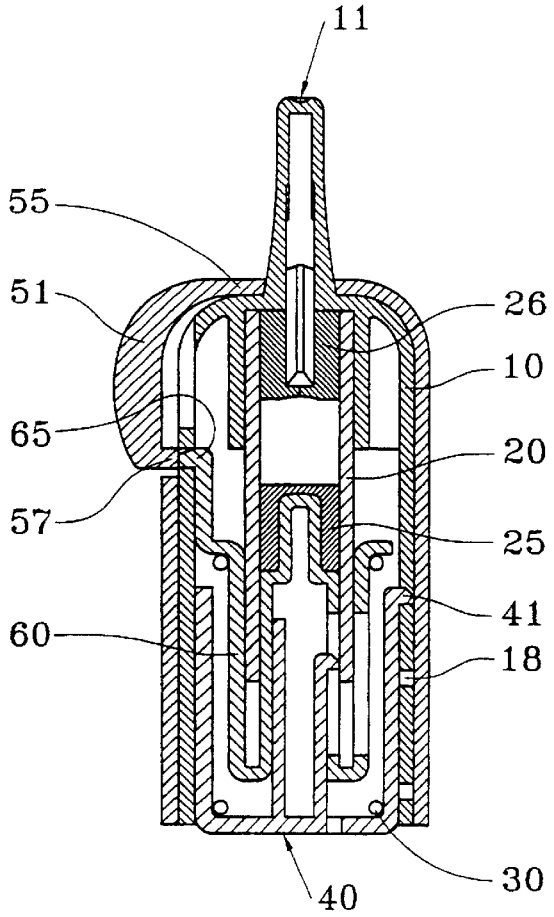
FIG. 6 is a view similar to the views of FIGS. 4 and 5, before the second dose is dispensed.
Figure 7:
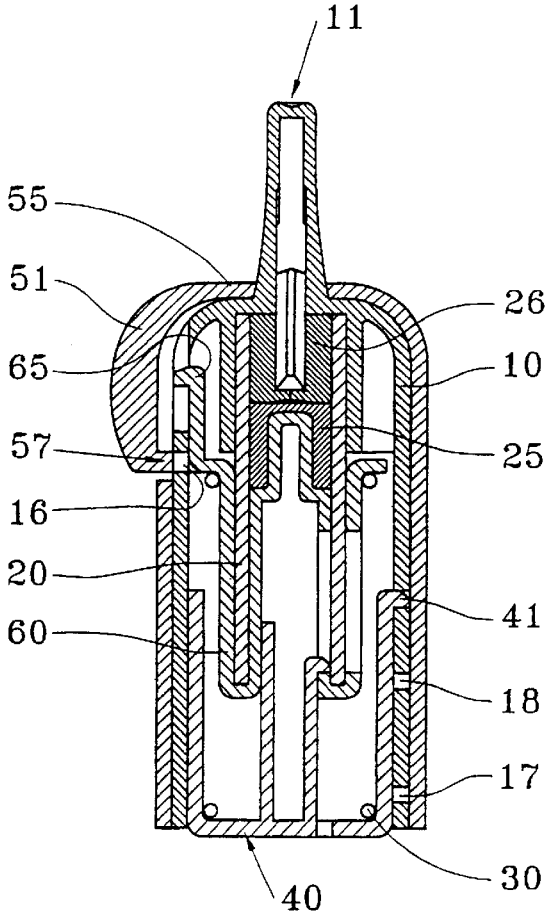
FIG. 7 is a view similar to the views of FIGS. 4 to 6, after the second dose is dispensed.

FIGS. 4 to 7 show a second embodiment of the invention. The general operation of the device is similar to that of the first embodiment, the difference being that the intermediate element 60 co-operates with the piston 25, while the reservoir 20 is stationary relative to the body 10. Advantageously, in the second embodiment, the reservoir is made in the form of a glass tube 21 that is open at both ends, and that is closed off at one end by the piston 25 which co-operates with the intermediate element 60, and at the other end by a leaktight stopper 26 adapted to open when a predetermined pressure is generated inside the reservoir 20 by the movement of the piston 25. Advantageously, said stopper 26 is made similarly to the piston 25 of the first embodiment, i.e. with a slit. The cocking stages for the first and second doses, and the triggering for releasing the intermediate element 60 are similar to those of the first embodiment, and are thus not described any more fully below. FIGS. 4 to 7 show the various dispensing stages. FIG. 4 shows the cocked position before the first dose is dispensed, in which the cocking member is in its first locked position and the intermediate element is in its first locked position. FIG. 5 shows the position after the first dose has been dispensed, in which the cocking member 40 is still in the first locked position while the intermediate element 60 is in its second locked position. FIG. 6 shows the device before its second dose is dispensed, the cocking member being in its second locked position, and the intermediate element also being in its second locked position. Finally, FIG. 7 shows the device after the second dose of fluid has been dispensed, the piston 25 having completely emptied the reservoir, and having come into abutment against the top stopper 26.

Figure 8:
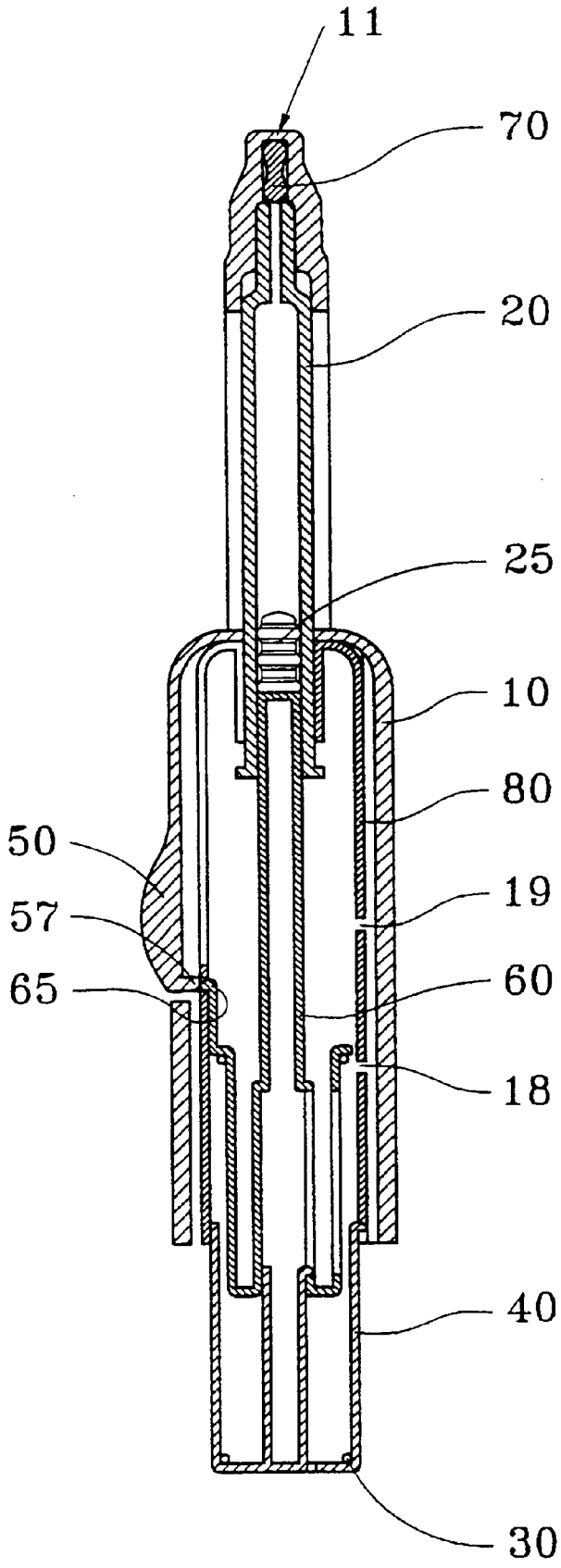
FIG. 8 is a diagrammatic view in cross section of another variant embodiment of the present invention, before the first dose is dispensed.

FIG. 8 shows another variant embodiment of the present invention. In this variant, the reservoir 20 is a syringe, advantageously of standard type, closed off at one end by a piston 25, also advantageously of standard type, and having, at the end opposite from the dispensing orifice 11, an end-piece 70 advantageously forming closure means when in the rest position, and making it possible to define a spray profile while the fluid is being dispensed. This variant makes it possible to use a reservoir that is well known and easy to fill, and that can be pre-filled by the manufacturer of the fluid to be dispensed, and closed off at its two end (at one end by the piston 25 and at the other end by the end-piece 70) so that it can be finally fixed in the body 10 during assembly of the dispenser device. It may be fixed by any means. In this variant shown in FIG. 8, the intermediate element 60 co-operates with the piston 25, and moves it inside the reservoir 20. The cocking and triggering stages for dispensing the doses are similar to those in the two preceding embodiments. However, FIG. 8 shows a variant embodiment of the dispenser device in that the triggering members 50 and 51 (the second triggering member 51 is not shown), are formed directly on the body 10. In which case, an inner sleeve 80 is advantageously fixed inside the body 10, said sleeve 80 being provided with the openings 15 to 19 which make it possible to define the locked positions of the cocking member 40 and the locked positions of the intermediate element 60. Naturally, this variant embodiment is entirely applicable to the first embodiments described with reference to FIGS. 1 to 7. The use of a syringe of standard type is advantageous in that it enables the manufacturer of the fluid to be dispensed to fill the reservoir very simply without requiring different special tools for filling a different special reservoir. Since the syringe is pre-filled and closed off in leaktight manner, the dispenser device can also be assembled under non-sterile conditions.

The present invention thus provides a dispenser device that is advantageously of the two-dose type, and that simultaneously provides the following functions:

it guarantees operating safety by enabling the doses to be dispensed while the device is in any position, and by preventing the second dose from being actuated accidently before the first dose has been dispensed;

it facilitates dispensing of the fluid by being actuated from the side, since the fluid is dispensed independently of the force exerted by the user, because it is a spring that performs the dispensing; in particular, the spring guarantees constant characteristics for the spray;

it guarantees that the fluid is contained in the reservoir in leaktight manner before, during and after the dispenser is actuated;

in the first embodiment shown in FIGS. 1 to 3 and in the third variant shown in FIG. 8, it makes it possible to use a pre-filled reservoir, so that the device can be assembled under non-sterile conditions; and it limits the risks of the fluid being contaminated since it puts the fluid in contact with two materials only, namely the material of the reservoir, which is glass in general, and the material of the stopper piston 25 and/or 26, which, in general, is an elastomer material that is inert relative to the fluid.

Naturally, as already mentioned at the beginning of the description, the present invention is not limited to two-dose type devices or to nasal-type devices. It is possible, for example, to consider such a device for dispensing one, three, or four doses, for example into the eyes, the ears, or the mouth of the user.

What is claimed is:

1. A fluid dispenser device comprising: a body (10) defining a dispensing orifice (11); a reservoir (20) containing one or more doses of fluid, said reservoir (20) having a piston (25) which, at rest, forms a leaktight stopper; a resilient element (30), such as a spring; an intermediate element (60) secured to said reservoir (20) or to said piston (25), said resilient element (30) co-operating firstly with said intermediate element (60) and secondly with a cocking member (40); and at least one triggering member (50, 51); said device being characterized in that said cocking member (40) co-operates with said body (10) in a rest position in which said resilient element (30) is not compressed, is mounted to be movable manually relative to said body (10) so as to compress said resilient element (30), and is mounted to be lockable relative to said body (10) in at least one locked position in which said resilient element (30) is compressed and in which said intermediate element (60) is locked relative to said body (10) in a locked position, said at least one triggering member (50, 51) co-operating with said intermediate element (60) so as to release it from its locked position so that said resilient element (30) moves said piston (25) relative to said reservoir (20) so as to expel a dose of fluid.

2. A device according to claim 1, in which said piston (25) co-operates in stationary manner with said body (10) and said spring (30) co-operates with said intermediate element (60) secured to said reservoir (20) and mounted to move with said reservoir (20) relative to said body (10), said intermediate element (60) being locked relative to said body (10) in at least one locked position, and being released by said at least one triggering member (50, 51), so that, by moving with the reservoir (20) relative to said body (10) under the effect of the spring (30), the intermediate element (60) moves said piston (25) in said reservoir (20) so as to dispense a dose of fluid.

3. A device according to claim 2, in which said reservoir (20) includes a hollow tube (21) that is open at one end only, which end is closed off by a stopper piston (25) provided with a slit adapted to open under the effect of a determined pressure generated inside the reservoir (20) by the movement of the piston (25), so as to dispense the fluid from the reservoir (20) towards the dispensing orifice (11).

4. A device according to claim 2, in which, after being filled and closed off in leaktight manner by said piston (25) said reservoir (21) is fixed, in particular by snap-fastening, to said intermediate element (60).

5. A device according to claim 1, in which said reservoir (20) is fixed to said body (10), and said piston (25) co-operates with said intermediate element urged by said spring (30) and that moves with said piston (25) relative to said body (10), said intermediate element (60) being locked relative to said body (10) in at least one locked position, and being released by said at least one triggering member (50, 51), so that, by moving with the piston (25) relative to said body (10) under the effect of the spring (30), the intermediate element (60) moves said piston (25) in said reservoir (20) so as to dispense a dose of fluid.

6. A device according to claim 5, in which said reservoir includes a hollow tube (21) that is open at both ends, and that is closed off at one end by said piston (25) co-operating with the intermediate element (60) and at the other end by a stopper (26) co-operating in stationary manner with the body (10), said stationary stopper (26) being provided with a slit adapted to open under the effect of a determined pressure generated inside the reservoir (20) by the piston (25) moving, so as to dispense the fluid from the reservoir to the dispensing orifice.

7. A device according to claim 2, in which said intermediate element (60) has at least one locking element (65), such as a resilient catch, co-operating with at least one opening (15, 16) in the body (10) to lock said intermediate element (60) relative to said body (10), said intermediate element (60) being released by said at least one triggering member (50, 51) co-operating with said at least one locking catch (65) through said at least one opening (15, 16).

8. A device according to claim 2, in which said at least one triggering member (50, 51) is made in the form of a side push button mounted to move radially and adapted to co-operate with said intermediate element (60).

9. A device according to claim 2, in which said at least one triggering member (50, 51) is formed on an external element (55) fixed to said body (10) and it is provided with an inwardly-projecting lug (57) adapted to co-operate with said intermediate element (60) through at least one corresponding opening (15, 16) provided in said body (10) when the triggering member (50, 51) is actuated.

10. A device according to claim 2, in which said reservoir (20) contains two doses of fluid, said cocking member (40) has two distinct locked positions, one for each dose, said intermediate element (60) has two distinct locked positions, one for each dose, and said device has two distinct triggering members (50, 51) one for each dose.

11. A device according to claim 10, in which the two triggering members (50, 51) are offset axially and/or peripherally relative to each other on the body (10) of the device.

12. A device according to claim 2, in which the reservoir (20) is a syringe which, at one end, includes a piston (25) that co-operates with said intermediate element (60), and, at the other end, includes an end-piece (70) which, at rest, forms closure means, and, when the device is actuated, defines a spray profile at the dispensing orifice (11).

13. A device according to claim 2, in which said body (10) incorporates said at least one triggering member (50, 51), and an inner sleeve (80) is fixed in said body (10), said sleeve (80) co-operating with said intermediate element (60), and with said cocking member (40) to define their respective locked positions, and co-operating with said at least one triggering member (50, 51) to release said intermediate element (60).

14. A device according to claim 1, in which said cocking member (40) is released from its locked position(s) when the user exerts a predetermined axial force on it.

15. A device according to claim 1, in which said reservoir (20) is made of glass, and said piston (25) is made of an elastomer material.

* * * * *